US009371722B2

(12) United States Patent
Balczewski

(10) Patent No.: US 9,371,722 B2
(45) **Date of Patent: *Jun. 21, 2016**

(54) ENHANCING PRODUCTION OF CLATHRATES BY USE OF THERMOSYPHONS

(71) Applicant: Chevron U.S.A. Inc., San Ramon, CA (US)

(72) Inventor: John Thomas Balczewski, San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 314 days.

This patent is subject to a terminal disclaimer.

(21) Appl. No.: 13/965,669

(22) Filed: Aug. 13, 2013

(65) Prior Publication Data

US 2014/0041872 A1 Feb. 13, 2014

Related U.S. Application Data

(60) Provisional application No. 61/682,569, filed on Aug. 13, 2012.

(51) Int. Cl.
*E21B 43/24* (2006.01)
*E21B 43/01* (2006.01)

(52) U.S. Cl.
CPC ..... *E21B 43/24* (2013.01); *E21B 2043/0115* (2013.01)

(58) Field of Classification Search
CPC ..... E21B 43/24; E21B 2043/0115
See application file for complete search history.

(56) References Cited

U.S. PATENT DOCUMENTS 2,181,654 A * 11/1939 Davenport ..... E21B 43/24 122/34
3,217,791 A * 11/1965 Long ..... E02D 3/115 165/104.21
3,580,330 A * 5/1971 Maugis ..... F24J 3/085 165/135
4,424,858 A * 1/1984 Elliott ..... E21B 43/121 166/116
4,566,527 A * 1/1986 Pell ..... F28D 15/04 165/104.21
4,961,463 A 10/1990 DenHartog et al.
5,190,098 A 3/1993 Long
5,238,053 A 8/1993 Long
5,272,891 A * 12/1993 Erickson ..... F24H 4/04 62/477
5,327,734 A * 7/1994 Haynes ..... E02D 3/115 165/104.21
6,116,290 A * 9/2000 Ohrn ..... F16L 59/143 138/113
6,656,366 B1 * 12/2003 Fung ..... B08B 9/055 210/194

(Continued)

*Primary Examiner* — Zakiya W Bates
*Assistant Examiner* — Crystal J Miller
(74) *Attorney, Agent, or Firm* — Melissa M. Hayworth; Marie L. Clapp; Mary R. Bram

(57) ABSTRACT

A method and system for initiating hydrocarbon production from a reservoir are provided. This method and system utilize thermosyphons. The system and method utilize one or more sealed, elongated, hollow tubular containers supported in earth in a geothermal heat zone below the reservoir and extending upwardly therefrom into the reservoir. The containers comprise (a) a bottom portion in the geothermal heat zone below the reservoir; (b) a top portion within the reservoir; and (c) being partially filled with a liquid that evaporates in the bottom portion forming a vapor and transferring heat via convective flow of the vapor to the top portion, the heat being dissipated at the top portion into the surrounding reservoir as the vapor condenses back into liquid and flows downward to the bottom portion. The reservoir can be a natural gas hydrate reservoir.

29 Claims, 2 Drawing Sheets

(56) References Cited

U.S. PATENT DOCUMENTS 7,165,621 B2 * 1/2007 Ayoub ..... E21B 41/0064 166/268
7,343,753 B2 * 3/2008 Kidwell ..... C10L 3/10 165/45
7,604,054 B2 * 10/2009 Hocking ..... E21B 36/00 166/280.1
2003/0066642 A1 * 4/2003 Wellington ..... C09K 8/592 166/245
2003/0075318 A1 * 4/2003 Keedy ..... C09K 8/592 166/60
2003/0085034 A1 * 5/2003 Wellington ..... C09K 8/592 166/248
2006/0032637 A1 * 2/2006 Ayoub ..... E21B 41/0064 166/369
2007/0144943 A1 6/2007 Lemaire et al.
2007/0199707 A1 * 8/2007 Hocking ..... E21B 36/00 166/280.1
2010/0006281 A1 * 1/2010 DuBrucq ..... B01D 5/0009 166/249
2010/0011663 A1 1/2010 Coyle
2014/0041871 A1 * 2/2014 Balczewski ..... E21B 43/24 166/302

* cited by examiner

ENHANCING PRODUCTION OF CLATHRATES BY USE OF THERMOSYPHONS

PRIORITY CLAIM

This application claims priority to U.S. Provisional Application No. 61/682,569, filed Aug. 13, 2012, entitled "Hydrocarbon Production Using Passive Thermodynamic Heat Transfer Devices", the contents of which are incorporated herein by reference in their entirety. This application is related to application Ser. No. 13/965,642, filed Aug. 13, 2013, now issued as U.S. Pat. Ser. No. 9,222,342, entitled "Initiating Production of Clathrates by Use of Thermosyphons", which is herein incorporated by reference in its entirety.

FIELD OF THE INVENTION

The present application relates to a method and system for enhancing hydrocarbon production using passive thermodynamic heat transfer devices. In particular, the present application relates to a method and system for enhancing production of hydrocarbon reservoirs by use of thermosyphons, including reservoirs of clathrates of natural gas, also called gas hydrates.

BACKGROUND OF THE INVENTION

If proponents of Hubbert peak theory are correct, world oil production will at some point peak, if it has not done so already. Regardless, world energy consumption continues to rise at a rate that outpaces new oil discoveries. As a result, alternative sources of energy must be developed, as well as new technologies for maximizing the production and efficient consumption of oil.

In maximizing the production of oil, deepwater and permafrost drilling are being developed because they allow for production of oil and gas in reservoirs that have previously been inaccessible. Deepwater drilling is the process of oil and gas exploration and production in depths of more than 500 feet. Permafrost drilling is the process of oil and gas exploration and production in areas where seasonal temperatures are cold enough for permafrost to exist. Both had been economically infeasible for many years, but with rising oil prices, more companies are now routinely investing in these areas.

In addition to conventional oil and gas development, attractive alternative sources of energy may be developed. One potentially very large alternative source of energy is marine and permafrost natural gas sequestered in materials called clathrates. A clathrate is a chemical compound in which molecules of one material (the "host") form a solid lattice that encloses molecules of one or more other materials (the "guest(s)"). Clathrates are also called inclusion compounds and important features of clathrates are that not all the lattice cells are required to be filled (i.e. they are non-stoichiometric) and the guest molecule(s) are not chemically bound to the host lattice.

Naturally-occurring clathrates of natural gas form when water 'host' molecules and certain low molecular weight hydrocarbon gas 'guest' molecules are brought together under suitable conditions of relatively high pressure and relatively low temperature. Under these conditions the "host" water molecules will form a cage or lattice structure capturing one or more hydrocarbon "guest" gas molecules inside. Large quantities of hydrocarbon gas are closely packed together by this mechanism. For example a cubic meter of natural gas hydrate contains approximately 0.8 cubic meters of water and generally 164 cubic meters of natural gas at standard temperature and pressure conditions.

Methane is the most common guest molecule in naturally-occurring clathrates of natural gas. Many other low molecular weight gases also form hydrates, including hydrocarbon gases such as ethane and propane and non-hydrocarbon gases such as CO2 and H2S.

Natural gas hydrates form naturally and are widely found at about 200 meters depth below the surface in permafrost areas, potentially within and below the permafrost layer. Natural gas hydrates also are found in sediments along continental margins at water depths generally greater than 500 meters (1600 feet) at mid to low latitudes and greater than 150-200 meters (500-650 feet) at high latitudes. The thickness of the hydrate stability zone varies with temperature, pressure, composition and availability of the hydrate-forming gas, underlying geologic conditions, water depth, salinity, and other factors.

Estimates of the amount of methane sequestered globally in natural gas hydrates have varied widely. The earliest estimates ranged between 100,000 and 100,000,000 trillion cubic feet (TCF). Since the start of dedicated drilling in the mid-1990s researchers learned that the percentage of natural gas hydrates within the pore spaces of marine sediments (referred to as natural gas hydrate saturation) were often far lower than the theoretical maximum saturation. This led to downward revisions of the amount of methane sequestered globally in natural gas hydrates to between 100,000 and 5,000,000 TCF with the most frequently quoted estimate of 700,000 TCF (a number which excludes any hydrates located in Antarctic or alpine permafrost areas). Even the lowest estimate represents an enormous potential new energy resource, equal to more than 4,000 times the amount of natural gas consumed in the US in or 18 times the entire world's proven gas resources.

Recognizing that only a fraction of the globally sequestered methane is likely to be concentrated enough and accessible enough to be produced, and acknowledging that to date there has never been a long-term production test of natural gas hydrates, it is still clear that natural gas hydrates have the potential to become a very large new energy source for the world.

To produce gas from natural gas hydrates the natural gas hydrates must first be converted back ("dissociated") into water (either liquid or ice) and producible free gas molecules by one or any combination of four methods:

- Addition of heat until the natural gas hydrate is outside the phase stability envelope
- Reduction of pressure (depressurization) until the natural gas hydrate is outside the phase stability envelope
- Addition of a hydrate inhibitor such as a salt, methanol, etc. to shift the phase stability envelope to the point where the natural gas hydrate is outside the phase stability envelope
- Molecular substitution, where one type of guest molecule is substituted for another Although only a few natural gas hydrate production tests have taken place, all of very limited duration, significant work with reservoir simulators and laboratory experiments have led those experienced in the art to generally believe that depressurization would the most economical form of natural gas hydrate production.

It is also a widely held belief that natural gas hydrate reservoirs could be produced using largely conventional and production technologies.

Regardless of the production method, natural gas hydrate dissociation is an endothermic process, meaning it is a process that is limited by how much thermal energy is available in the vicinity. As the endothermic dissociation process proceeds and draws thermal energy from adjacent sediments, it causes them to cool. A natural consequence of dissociation of cold natural gas hydrates is the potential freezing of adjacent portions of the reservoir. Freezing of adjacent portions of the reservoir would effectively plug the well because of the very long time spans required for the frozen reservoir to naturally thaw. Addition of localized heat to thaw the frozen reservoir would also be a possible solution, but so much heat would need to be applied the economic impact would make this method prohibitive.

Natural gas hydrate reservoirs that are at pressures and/or temperatures well inside the hydrate phase stability zone (i.e. reservoirs that are very cold and/or under very high pressure) will require significant drops in pressure and/or addition of heat to initiate dissociation and will likely have limited ambient thermal energy in the surrounding sediments above and below the natural gas hydrates to support economic rates of gas production. The most desirable natural gas hydrate reservoirs are therefore those that warm and at or near the phase stability envelope. Unfortunately, it is a matter of geologic chance whether a given natural gas reservoir would meet such desirable characteristics.

Most of the natural gas hydrate research to date has focused on basic research, as well as detection and characterization of hydrate reservoirs. Extraction methods that are commercially viable and environmentally acceptable are still at an early developmental stage.

Therefore, technologies must be further developed before these additional sources of hydrocarbons become commercially-viable sources of energy.

SUMMARY OF THE INVENTION

As described herein, a method and system for enhancing hydrocarbon production are provided.

In one embodiment, a system for enhancing production of one or more reservoirs is provided. The system comprises one or more sealed, elongated, hollow tubular containers placed in cased holes and production wells installed in the cased holes above the containers. The containers are supported in earth in a geothermal heat zone below the reservoir and extending upwardly therefrom into the reservoir. The containers comprise (a) a bottom portion in the geothermal heat zone below the reservoir; (b) a top portion within the reservoir; and (c) being partially filled with a liquid that evaporates in the bottom portion forming a vapor and transferring heat via convective flow of the vapor to the top portion, the heat being dissipated at the top portion into the surrounding reservoir as the vapor condenses back into liquid and flows downward to the bottom portion. In one embodiment the reservoir is a natural gas hydrate reservoir.

In another embodiment, a method for enhancing production of hydrocarbons from a reservoir is provided. The method comprises a) locating a reservoir and b) inserting one or more sealed, elongated, hollow tubular containers in earth in a geothermal heat zone below the reservoir and extending upwardly therefrom into the reservoir. The containers comprise (i) a bottom portion in the geothermal heat zone below the reservoir; (ii) a top portion within the reservoir; and (iii) being partially filled with a liquid that evaporates in the bottom portion forming a vapor. The method further comprises c) transferring heat from the geothermal heat zone below the reservoir to within the reservoir by convective flow of the vapor to the top portion, the heat being dissipated at the top portion into the surrounding reservoir as the vapor condenses back into liquid and flows downward to the bottom portion; d) raising the temperature of the reservoir; e) producing hydrocarbons from the reservoir; and f) collecting the hydrocarbons. In one embodiment the reservoir is a natural gas hydrate reservoir.

In another embodiment, a method for enhancing production of natural gas hydrates is provided. The method comprises a) locating a natural gas hydrate reservoir at a temperature and pressure such that the natural gas hydrates are stable and b) inserting one or more sealed, elongated, hollow tubular containers in earth in a geothermal heat zone below the natural gas hydrate reservoir and extending upwardly therefrom into the natural gas hydrate reservoir. The containers comprise (i) a bottom portion in the geothermal heat zone below the natural gas hydrate reservoir; (ii) a top portion within the natural gas hydrate reservoir; and (iii) being partially filled with a liquid that evaporates in the bottom portion forming a vapor. The method further comprises c) transferring heat from the geothermal heat zone below the natural gas hydrate reservoir to within the natural gas hydrate reservoir by convective flow of the vapor to the top portion, the heat being dissipated at the top portion into the surrounding reservoir as the vapor condenses back into liquid and flows downward to the bottom portion; d) raising the temperature of the natural gas hydrate reservoir moving the reservoir closer to but not over a phase boundary to dissociation; e) initiating dissociation; f) producing natural gas; and g) collecting the natural gas produced from the hydrates.

DETAILED DESCRIPTION OF THE INVENTION

Figure 1:
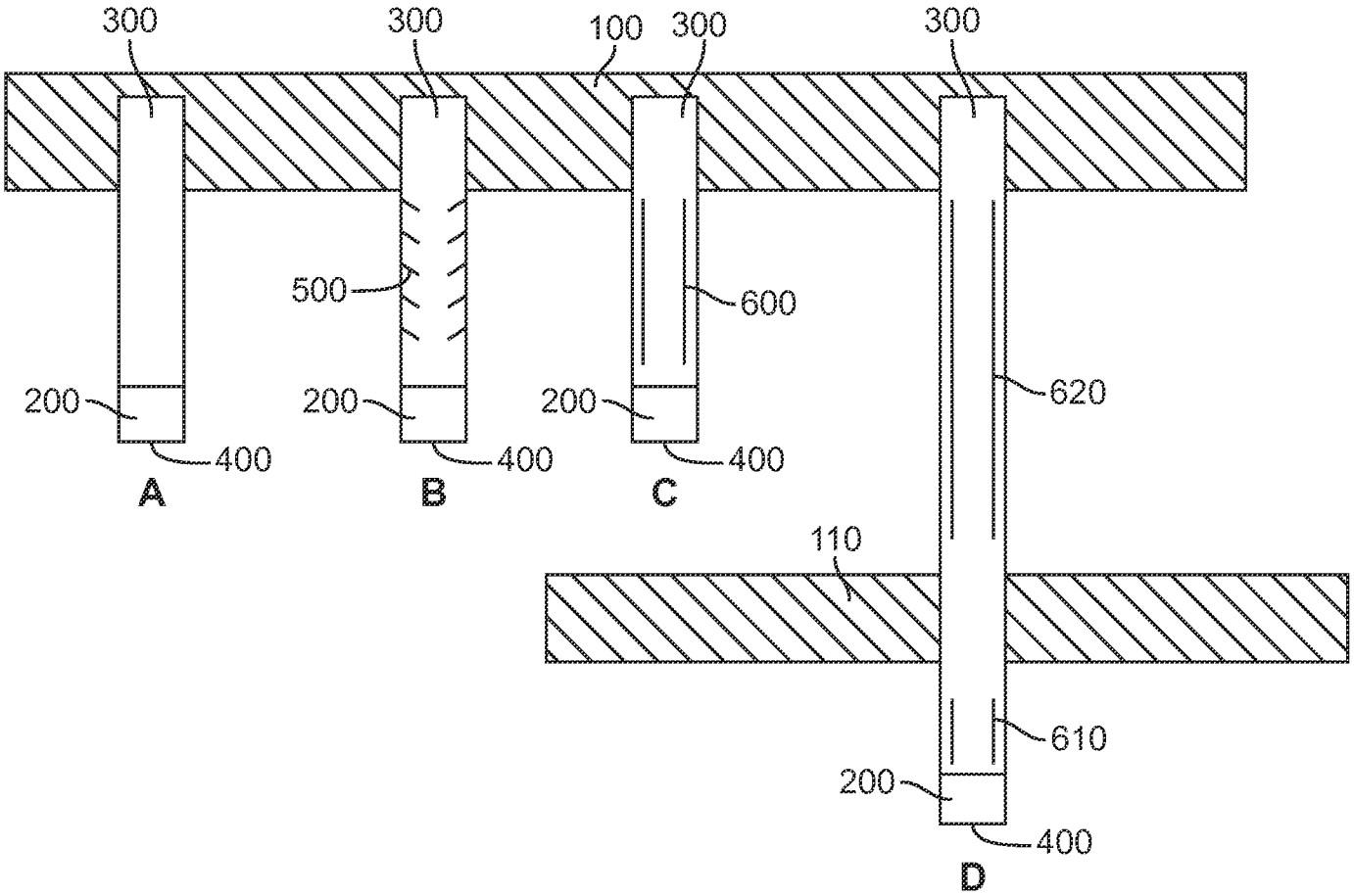
FIG. 1 illustrates four embodiments (A, B, C, and D) of the containers inserted in earth in a geothermal heat zone below a reservoir for production.

The present application provides a method and a system for enhancing production of one or more reservoirs. This method and system utilize thermosyphons. The method and system for enhancing production reduce production costs associated with the reservoir and also increase hydrocarbon production rates and efficiencies above existing conditions. The reservoir can be a natural gas hydrate reservoir.

Definitions

In accordance with this detailed description, the following abbreviations and definitions apply. It must be noted that as used herein, the singular forms "a", "an", and "the" include plural referents unless the context clearly dictates otherwise. Thus, for example, reference to a "liquid" includes one and a plurality of such.

Unless otherwise stated, the following terms used in the specification and claims have the meanings given below:

"Container" is one or more sealed, elongated hollow tube(s).

"NHG" is natural gas hydrates or clathrate hydrates of natural gas. These hydrates form when water and the gas molecules are brought together under suitable conditions of relatively high pressure and low temperature.

"Reservoir" is a hydrocarbon reservoir and as used herein includes natural gas hydrate reservoirs, heavy oil reservoirs and tar sands reservoirs.

"GeoThermal Heat Zone" or GTHZ means a location in the earth deeper and thus hotter than the reservoir. The deeper locations are hotter due to geothermal gradients.

"Liquids" as used herein are fluids with a suitable boiling point at suitable pressures to enable boiling at and/or below the GTHZ temperature. Liquids include, for example, propane, butane, pentane, hexane, heptane, octane, dimethyl ether, methyl acetate, fluorobenzene, 2-heptene, carbon dioxide, ammonia and mixtures thereof. Liquids include any fluid of suitable boiling point in combination with the pressure relative to the GTHZ to be boiled forming vapor within the GTHZ and condensing back into liquid at the temperature and pressure of the reservoir.

"Phase boundary" relate to changes in the organization of matter, such as a change from liquid to vapor/gas or solid to liquid. When a substance undergoes a phase transition (changes from one state of matter to another), it usually either takes up or releases energy. Phase diagrams are common ways to represent the various phases of a substance and the conditions under which each phase exists.

"Remote" means a location that is at least 100, more preferably 500 miles, offshore.

"Subsea" means at a depth beneath the surface of the water.

"Optional" or "optionally" means that the subsequently described event or circumstance may, but need not, occur, and that the description includes instances where the event or circumstance occurs and instances in which it does not.

The present application relates to developing reservoirs that are traditionally difficult to develop for economic and/or technological reasons. These reservoirs include natural gas hydrate reservoirs, heavy oil reservoirs, and tar sands reservoirs. To access the heavy oil reservoirs and tar sands reservoirs, it is necessary to promote a phase transition from solid to liquid or a viscosity change from high viscosity to lower viscosity, to pump the desired hydrocarbon product. To access the natural gas trapped in the hydrates, it is necessary to move the natural gas hydrates closer to but not across a phase boundary to dissociation and then in a controlled manner promote dissociation to obtain the desired natural gas product.

The present system and method addresses heating these reservoirs in an economically viable and environmentally desirable way. The present system and methods enhance production of the hydrocarbons from these unconventional reservoirs.

The system and method of the present application enhance production of hydrocarbons from these one or more reservoirs. The system and method utilize one or more sealed, elongated, hollow tubular containers supported in the earth in a geothermal heat zone below the reservoir and extending upwardly therefrom into the reservoir. The geothermal heat zone is a location in the earth deeper and thus hotter than the reservoir. The geothermal heat zone may be 40 to 150° C. In some embodiments, the geothermal heat zone may be 40° C. In other embodiments, the geothermal heat zone may be 60° C. or 100° C. The temperature of the geothermal heat zone will depend on the location and depth. The temperature can be determined by conventional methods by one of ordinary skill in the art.

The containers comprise a bottom portion in the geothermal heat zone below the reservoir and a top portion within the reservoir. The containers are of an appropriate length and inserted into the earth so that they are at the desired location within the earth. They are inserted so that the bottom portion is at a depth within the geothermal heat zone at an appropriate temperature higher than the reservoir and the top portion is within the reservoir to be developed. Geothermal gradients result in the increased temperature with increased depth and can be determined by one of ordinary skill in the art.

The containers utilize passive heat exchange based on natural temperature differentials in the earth. The containers do not require a pump or any moving parts. Accordingly, the system is simple, low cost, and robust.

The containers are partially filled with a liquid. The containers partially filled with the liquid are sealed. The liquid is selected based on the sealed pressure inside the container and the geothermal temperature at the bottom of the container. The liquid is selected so that at the temperature and pressure of the bottom portion of the container, the liquid boils forming a vapor and at the temperature and pressure of the top portion of the container within the reservoir, the liquid condenses back to a liquid. Knowing the temperature of the geothermal heat zone and the reservoir and determining an appropriate sealing pressure for the container, one of ordinary skill in the art can readily select a liquid. The liquids are utilized having suitable boiling points at suitable pressures to enable boiling at and/or below the temperature of the geothermal heat zone and enable condensation at/or below the temperature of the reservoir. The liquid can be selected from the group consisting of propane, butane, pentane, hexane, heptane, octane, dimethyl ether, methyl acetate, fluorobenzene, 2-heptene, carbon dioxide, ammonia and mixtures thereof.

One of ordinary skill in the art can calculate the depth to insert the containers to achieve heat transfer from the geothermal heat zone below the reservoir to within the reservoir using the properties of the liquid and the sealing pressure. One of ordinary skill in the art can also determine the number of containers needed and how densely to arrange the containers based on the desired heating.

The liquid evaporates in the bottom portion of the container forming a vapor and transferring heat via convective flow of the vapor to the top portion, the heat being dissipated at the top portion into the surrounding reservoir as the vapor condenses back into liquid and flows downward to the bottom portion. This cycle is repeated indefinitely transferring heat from the geothermal heat zone to the reservoir.

Conveniently, the container can be made of and inserted into appropriate locations using common drilling equipment and tools, drilling equipment and tools that would be necessary to develop a hydrocarbon reservoir. The container can be one or more joints of new or used drilling pipe filled with the liquid and sealed under pressure, one or more joints of new or used drilling casing filled with the liquid and sealed under pressure, or one or more lengths of pipe filled with liquid and sealed under pressure. The pipe can be made of any appropriate material, including for example metallic or polymeric. The container can be sealed with removable packers or removable seals.

The container can be placed in cased drill holes or in open drill holes. The drilled hole can be sealed between the surface and top of the system with drilling mud or concrete. If the containers are placed in cased drilling holes, at a later date production wells can be installed into the same cased wells, when it is appropriate to begin production of hydrocarbons from the reservoir. In the systems for enhancing production of one or more reservoirs, the containers can be placed in cased holes and production wells can be installed in the cased holes above the containers.

These containers are fail safe in that any breach of the outer container will simply release the liquid and disperse it in the localized sediments. The containers will then cease to function and will become a deeply buried stub of pipe. By appropriate choice of burial depth, pressure, and filling liquid, these containers will not overheat the reservoir.

The container forms a vertical closed-loop circuit for circulation of the liquid and vapor enabling passive heat exchange from the geothermal heat zone to within the reservoir. As such, the container heats the reservoir producing the desired result within the reservoir. For instance, for heavy oil or tar sands reservoirs, the container heats the reservoir reducing the viscosity of the hydrocarbon product. For natural gas hydrate reservoirs, the container heats the reservoir moving the hydrates closer to but not across a phase boundary to dissociation. Then in a controlled manner and at an appropriate time, dissociation can be promoted as part of a method of enhancing production of natural gas from the hydrates.

The container can be treated on an inner and/or an outer surface with protective materials. These protective materials can protect the integrity container from the environment in which it is buried. These protective materials can also protect the inner surface of the container from the liquid. These protective materials can also be insulating and assist in providing the appropriate environment for the heat exchange using the liquid. As such, the protective materials can be anti-corrosive, insulating, and the like.

The container can include one or more internally or externally insulated portions above the bottom portion and below the top portion to maximize the transmission of heat from the geothermal heat zone to the reservoir. Insulation can consist of various means, such as double-walled pipe, optionally with foam or vacuum in between the pipe walls. Applications of foam insulation of various compositions can also be applied. The insulated portions can be continuous or interrupted along the length of the container and may consist of a single layer or multilayer insulations and any combinations thereof.

The containers can be inserted into the ground to extend from the geothermal heat zone to the reservoir at any angle between horizontal to vertical or any combination of angles along the length of the container. The containers can contain curved sections so that the angle is not consistent over the entire length of the container. In certain embodiments, the containers are inserted at angles between 45° and vertical. The angle needs to allow the liquid to vaporize and condense and transfer heat from the geothermal heat zone to the reservoir.

The container can include additional components to enhance the thermal transfer properties and/or efficiencies between the bottom and top portions and between the system and surrounding earth. For example, the container can include internal baffles or plates to assist in vaporization and condensation of the liquid. The container can also include external fins or plates. In particular, it may be desirable to locate these external fins or plates at the top and/or bottom portions to enhance and extend the thermal transfer between the system and surrounding earth by increasing the exposed surface area. These additional components can be installed to in the containers either before it is inserted or after it is inserted.

The containers can be inserted into the ground such that the containers intersect more than one reservoir. As such, the container has an upper portion within an additional reservoir. This upper portion is distinct from the top portion and the additional reservoir is distinct from the reservoir in which the top portion is situated. In this instance, the container can include insulation in the areas of the container between reservoirs and in areas above the bottom portion in the geothermal heat zone.

Four embodiments (A, B, C, and D) of the containers inserted in earth in a geothermal heat zone below a reservoir for production are illustrated in FIG. 1. Container A within FIG. 1 illustrates the container comprising a bottom portion (400) in a geothermal heat zone below the reservoir (100) and a top portion (300) within the reservoir (100). The container is partially filled with a liquid (200) that evaporates in the bottom portion of the container forming a vapor and transferring heat via convective flow of the vapor to the top portion of the container. The heat is dissipated at the top portion of the container into the surrounding reservoir, heating the reservoir and raising the temperature of the reservoir as the vapor condenses back into liquid within the container and flows downward to the bottom portion.

Container B within FIG. 1 illustrates a container with internal baffles or plates (500) to assist in vaporization and condensation of the liquid (200). The internal baffles or plates (500) are located between the bottom portion (400) in the geothermal heat zone below the reservoir (100) and the top portion (300) within the reservoir (100).

Container C within FIG. 1 illustrates a container with an insulated portion (600) above the bottom portion (400) and below the top portion (300) to maximize the transmission of heat from the geothermal heat zone to the reservoir.

Container D within FIG. 1 illustrates a container inserted into the ground such that the container intersects two reservoirs (100 and 110). The two reservoirs (100 and 110) are distinct. The container includes a bottom portion (400) in a geothermal heat zone below the reservoirs (100 and 110), a top portion (300) within the reservoir (100) and an intermediate portion with reservoir (110). The container is partially filled with a liquid (200) that evaporates in the bottom portion of the container forming a vapor. The container includes insulation (620) in the areas of the container between reservoirs (100 and 110) and insulation (610) in the area above the bottom portion (400) in the geothermal heat zone.

These illustrations are not intended to be limiting. The container may include other components, such as external fins or plates at the bottom portion (400) and/or the top portion (300) that would maximize the transmission of heat from the geothermal heat zone to the reservoir.

These containers are utilized in methods for enhancing production of hydrocarbons from a reservoir. The methods comprise a) locating a reservoir; b) inserting the one or more sealed, elongated, hollow tubular containers into the earth in a geothermal heat zone below the reservoir and extending upwardly therefrom into the reservoir; c) transferring heat from the geothermal heat zone below the reservoir to within the reservoir; d) raising the temperature of the reservoir; e) producing hydrocarbons from the reservoir; and f) collecting the hydrocarbons. The containers comprise a bottom portion in the geothermal heat zone below the reservoir and a top portion within the reservoir. The containers are partially filled with a liquid that evaporates in the bottom portion forming a vapor. Heat is transferred by convective flow of the vapor to the top portion of the container, the heat being dissipated at the top portion into the surrounding reservoir as the vapor condenses back into liquid and flows downward to the bottom portion of the container. The heat dissipating into the surrounding reservoir raises the temperature of the reservoir. Raising the temperature of the reservoir increases the hydrocarbon production rates and efficiencies above existing conditions.

As described herein, the reservoir can be a natural gas hydrate reservoir, a heavy oil reservoir, or a tar sands reservoir. In one embodiment the reservoir is a natural gas hydrate reservoir. Production initiation may or may not extend into phase transition or significant viscosity reduction for the reservoir depending on design parameters, actual subsurface conditions, time in the ground for the containers, and the like. Methods of enhancing production do include phase transition and/or significant viscosity reduction depending on the reservoir so that a hydrocarbon product can be collected.

The reservoir can be located by conventional methods. Tar sand reservoirs are commonly found in Canada and Venezuela. Natural gas hydrates are common constituents of deepwater marine and permafrost environments. One of ordinary skill in the art can identify an appropriate reservoir of size and location for development. In certain embodiments of the present application, the systems can be inserted into existing reservoirs already in production to enhance the production of hydrocarbons therefrom and the methods can be applied to reservoirs already being produced to increase the hydrocarbon production rates and reduce the production costs.

In certain embodiments of the methods of the present invention, the reservoir can be a natural gas hydrate reservoir and the temperature of the reservoir can be raised moving the reservoir closer to, but not over, the phase boundary to dissociation. When appropriate, the method of enhancing production further includes decreasing the pressure of the natural gas hydrate reservoir and/or increasing the temperature beyond the NGH phase stability boundary initiating dissociation, producing natural gas, and collecting the natural gas produced from the hydrates. A cubic meter of natural gas hydrate contains 0.8 cubic meters of water and up to 170 cubic meters of methane gas.

The deepwater clathrate and permafrost reservoirs are relatively shallow depths below the sea floor and land surface, respectively; therefore, drilling and placing large numbers of the containers for enhancing production of the reservoir will be relatively inexpensive. In the method of enhancing production, large expanses of the containers can be placed and allowed to operate automatically for a period of time until the natural gas hydrate reservoir is at optimal conditions for production. This period of time can range from days to months to years. When ready to begin production of the reservoir, cased holes can be used for installation of the production wells. When beginning production, additional containers can be placed for additional heating for enhancing production. The containers can initially be inserted in cased holes and when ready to begin production, production wells can be installed in the same cased holes above the containers. During production, the remaining containers will continue to add heat to the reservoir preventing secondary hydrates from forming and blocking flow to the production wells. In addition, tranches of the containers can be removed when production is initiated in the area those containers were located and these containers can be relocated to the next production development area.

In other embodiments of the methods of enhancing production, the reservoir can be a heavy oil reservoir and the temperature of the reservoir can be raised such that the viscosity of the heavy oil is deceased. The viscosity of the heavy oil can be decreased to a point at which the heavy oil will flow freely. The systems as described herein can cause significant viscosity reduction to the point at which the heavy oil flows freely or additional techniques may be utilized to reach the point at which the heavy oil flows freely. One of ordinary skill in the art can select these additional techniques from conventional methods, such as steam injecting, solvent extraction, adding an additional heat source, if needed for further reducing the viscosity of heavy oil. At an appropriate time, the method of enhancing production includes flowing the heated heavy oil to a wellbore and collecting the heavy oil.

In other embodiments of the methods of enhancing production, the reservoir can be a tar sands reservoir and the temperature of the reservoir can be raised so that the hydrocarbons in the reservoir will eventually change from solid to liquid. The temperature can continue to be raised to a point at which the hydrocarbons in the reservoir change from solid to liquid. The systems as described herein can cause the tar sands to liquefy or additional techniques may be utilized to reach the point at which the tar sands liquefy. One of ordinary skill in the art can select these additional techniques from conventional methods, such as steam injecting, solvent extraction, adding an additional heat source, if needed. At an appropriate time, the method of enhancing production includes flowing the liquefied tar sands hydrocarbons to a wellbore and collecting the liquefied tar sands product.

Based on the geothermal gradient and the anticipated sealing pressure, a liquid is selected having a suitable boiling points at suitable pressures to enable boiling at and/or below the temperature of the geothermal heat zone and enable condensation at/or below the temperature of the reservoir.

The sealed elongated, hollow tubular containers are inserted into the earth in a geothermal heat zone below the reservoir and extending upwardly therefrom into the reservoir. One of ordinary skill in the art can calculate the depth to insert the containers to achieve heat transfer from the geothermal heat zone below the reservoir to within the reservoir using the properties of the liquid and the sealing pressure.

The liquid evaporates in the bottom portion of the container forming a vapor and transferring heat via convective flow of the vapor to the top portion, the heat being dissipated at the top portion into the surrounding reservoir as the vapor condenses back into liquid and flows downward to the bottom portion. This cycle is repeated indefinitely transferring heat from the geothermal heat zone to the reservoir.

The transfer of heat from deeper in the earth to the reservoir raises the temperature of the reservoir. Raising the temperature of the reservoir causes changes in the hydrocarbon reservoir within the reservoir, dependent upon the reservoir selected. As described above, when the reservoir is a heavy oil reservoir, the temperature is raised decreasing viscosity of the oil. When the reservoir is a tar sands reservoir, the temperature is raised eventually causing a phase change from solid to liquid for the hydrocarbon product. When the reservoir is a natural gas hydrate reservoir, the temperature is raised moving the reservoir closer to but not over the phase boundary to dissociation. In the present methods, raising the temperature and changing the characteristics of the hydrocarbon reservoir reduces the production costs associated with developing the reservoir and obtaining a product and also increases the natural gas production rates.

In methods of enhancing production, one of ordinary skill in the art can identify when it is appropriate to begin production of the reservoir based upon the characteristics of the hydrocarbon reservoir. The hydrocarbon reservoir is produced and collected and may then be upgraded into salable hydrocarbons. In methods of enhancing production, the systems disclosed herein could also be added to existing fields to enhance their production. Enhancing production using the systems disclosed herein increases hydrocarbon production rates and efficiencies.

Figure 2:
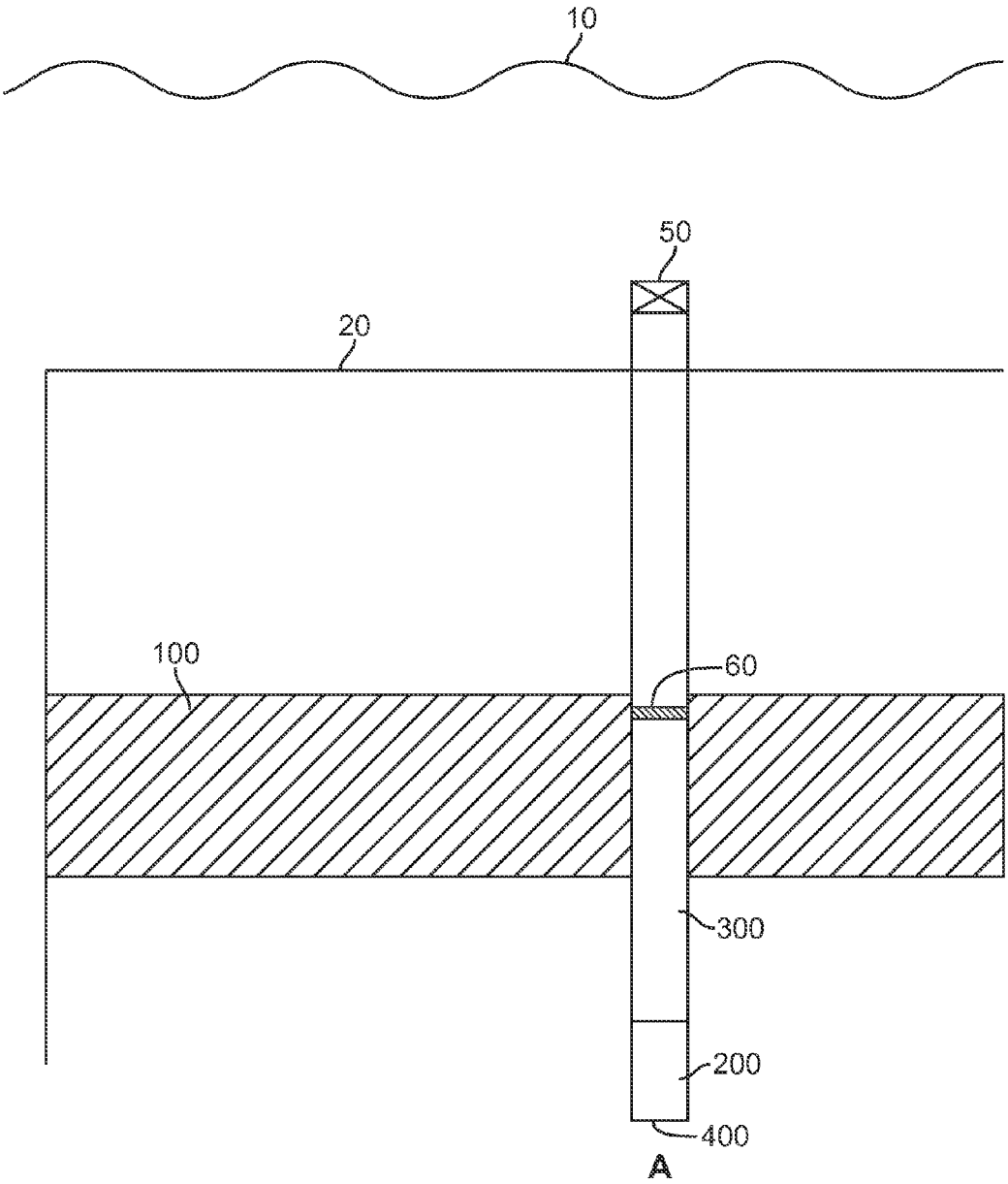
FIG. 2 illustrates a system for enhancing production of a natural gas hydrate reservoir located below the sea floor.

FIG. 2 illustrates a system for enhancing production of a natural gas hydrate reservoir (100) located below the sea floor. The system of FIG. 2 includes container A. FIG. 2 illustrates the surface of the ocean (10) and the seafloor (20) and the container (A) is inserted into the seafloor.

Container A is placed in a cased drilling hole sealed with a re-entry mechanism (50) so that at a later date production wells can be installed into the same cased well, when hydrocarbons are being produced from the reservoir. During production, the remaining container A will continue to add heat to the reservoir preventing secondary hydrates from forming and blocking flow to the production wells. Container A is sealed with removable packers or a removable seal (60).

Container A also includes a top portion (300) within the reservoir (100) and a bottom portion (400) in a geothermal heat zone below the reservoir (100). The container is partially filled with a liquid (200) that evaporates in the bottom portion of the container forming a vapor and transferring heat via convective flow of the vapor to the top portion of the container. The heat is dissipated at the top portion of the container into the surrounding reservoir, heating the reservoir and raising the temperature of the reservoir as the vapor condenses back into liquid within the container and flows downward to the bottom portion.

While the invention has been described in detail and with reference to specific embodiments thereof, it will be apparent to one skilled in the art that various changes and modifications can be made without departing from the spirit and scope thereof.

What is claimed is:

1. A system for enhancing production of one or more reservoirs comprising (i) one or more sealed, elongated, hollow tubular containers placed in cased holes and supported in earth in a geothermal heat zone below the reservoir and extending upwardly at any angle including and between vertical to horizontal or any combination of such angles along the length of the container therefrom into the reservoir and (ii) production wells installed in the cased holes above the containers, wherein the containers comprise (a) a bottom portion in the geothermal heat zone below the reservoir; (b) a top portion within the reservoir; and (c) being partially filled with a liquid that evaporates in the bottom portion forming a vapor and transferring heat via convective flow of the vapor to the top portion, the heat being dissipated at the top portion into the surrounding reservoir as the vapor condenses back into liquid and flows downward to the bottom portion.

2. The system of claim 1, wherein the liquid is selected from the group consisting of propane, butane, pentane, hexane, heptane, octane, dimethyl ether, methyl acetate, fluorobenzene, 2-heptene, carbon dioxide, ammonia and mixtures thereof.

3. The system of claim 1, wherein the container forms a vertical closed-loop circuit for circulation of the liquid and vapor enabling passive heat exchange from the geothermal heat zone to within the reservoir.

4. The system of claim 1, wherein the container is treated on an inner surface and/or an outer surface with protective materials.

5. The system of claim 4, wherein the protective materials are anti-corrosive or insulating.

6. The system of claim 1, wherein the container further comprises one or more internally and/or externally insulated portions above the bottom portion and below the top portion.

7. The system of claim 1, wherein the container further comprises an upper portion within one or more additional reservoirs, wherein the container comprises insulation in areas of the container between the reservoirs.

8. The system of claim 1, wherein the container further comprises internal baffles or plates.

9. The system of claim 1, wherein the container further comprises external fins or plates at the top portion and/or bottom portion.

10. The system of claim 1, wherein the reservoir is a natural gas hydrate reservoir.

11. A method for enhancing production of hydrocarbons from a reservoir comprising:

a) locating a reservoir;

b) inserting one or more sealed, elongated, hollow tubular containers in earth in a geothermal heat zone below the reservoir and extending upwardly therefrom into the reservoir, the containers comprising: (i) a bottom portion in the geothermal heat zone below the reservoir; (ii) a top portion within the reservoir; and (iii) being partially filled with a liquid that evaporates in the bottom portion forming a vapor;

c) transferring heat from the geothermal heat zone below the reservoir to within the reservoir by convective flow of the vapor to the top portion, the heat being dissipated at the top portion into the surrounding reservoir as the vapor condenses back into liquid and flows downward to the bottom portion;

d) raising the temperature of the reservoir;

e) producing hydrocarbons from the reservoir; and f) collecting the hydrocarbons.

12. The method of claim 11, wherein the container forms a vertical closed-loop circuit for circulating the liquid and vapor enabling passive heat exchange from the geothermal heat zone to within the reservoir.

13. The method of claim 11, wherein the reservoir is a natural gas hydrate reservoir and the method comprises moving the reservoir over the phase boundary initiating dissociation; producing natural gas; and collecting natural gas produced from the hydrates.

14. The method of claim 11, further comprising inserting the one or more containers at any angle including and between vertical to horizontal or any combination of such angles along the length of the container.

15. The method of claim 11, wherein the containers are selected from the group consisting of one or more joints of new or used drill pipe filled with the liquid and sealed under pressure, one or more joints of new or used drilling casing filled with the liquid and sealed under pressure, and one or more lengths of pipe filled with liquid and sealed under pressure.

16. The method of claim 15, further comprising placing the container in cased drill holes or in open drill holes.

17. The method of claim 16, further comprising sealing the drill hole with drilling mud or concrete.

18. The method of claim 15, further comprising sealing the container with removable packers or removable seals.

19. The method of claim 11, further comprising installing internal baffles or plates on the containers.

20. The method of claim 11, further comprising installing external fins or plates on the bottom portion and/or top portion of the containers.

21. The method of claim 11, further comprising selecting the liquid based on the geothermal heat zone and the sealing pressure.

22. The method of claim 21, further comprising calculating the depth to insert the containers to achieve heat transfer from the geothermal heat zone below the reservoir to within the reservoir by convective flow using the liquid and at the sealing pressure.

23. The method of claim 11, further comprising increasing hydrocarbon production rates.

24. The method of claim 11, further comprising relocating the containers from the initial location to an area in the reservoir where production development is beginning after producing the hydrocarbons begins.

25. The method of claim 11, further comprising inserting the containers in reservoirs in which hydrocarbons are being produced.

26. The method of claim 11, further comprising placing the container in cased drill holes and installing production wells in the cased holes above the containers.

27. A method of enhancing production of natural gas hydrates comprising:

a) locating a natural gas hydrate reservoir at a temperature and pressure such that the natural gas hydrates are stable;

b) inserting one or more sealed, elongated, hollow tubular containers in earth in a geothermal heat zone below the natural gas hydrate reservoir and extending upwardly therefrom into the natural gas hydrate reservoir, the containers comprising: (i) a bottom portion in the geothermal heat zone below the natural gas hydrate reservoir; (ii) a top portion within the natural gas hydrate reservoir; and (iii) being partially filled with a liquid that evaporates in the bottom portion forming a vapor;

c) transferring heat from the geothermal heat zone below the natural gas hydrate reservoir to within the natural gas hydrate reservoir by convective flow of the vapor to the top portion, the heat being dissipated at the top portion into the surrounding reservoir as the vapor condenses back into liquid and flows downward to the bottom portion;

d) raising the temperature of the natural gas hydrate reservoir moving the reservoir closer to but not over a phase boundary to dissociation;

e) initiating dissociation;

f) producing natural gas; and g) collecting the natural gas produced from the hydrates.

28. The method of claim 27, wherein dissociation is initiated by decreasing the pressure of the natural gas hydrate reservoir and/or increasing the temperature beyond the natural gas hydrate phase stability boundary.

29. The method of claim 27, further comprising increasing natural gas production rates.

* * * * *